US005841241A

United States Patent [19]

Nilssen

[11] Patent Number: 5,841,241

[45] Date of Patent: Nov. 24, 1998

[54] ELECTRONIC BALLAST FOR FLUORESCENT LAMPS

[75] Inventor: Ole K. Nilssen, Caesar Dr., Rte. 5, Barrington, Ill. 60010

[73] Assignee: Ole K. Nilssen, Barrington, Ill.

[21] Appl. No.: 839,065

[22] Filed: Feb. 19, 1992

Related U.S. Application Data

[63] Continuation of Ser. No. 158,104, Feb. 16, 1988, abandoned, Ser. No. 541,489, Oct. 13, 1983, abandoned, and Ser. No. 342,107, Jan. 25, 1982, abandoned.

[51] Int. Cl.[6] ..... H05B 37/00

[52] U.S. Cl. ..... 315/244; 315/219; 315/223; 315/287

[58] Field of Search ..... 315/209 R, 219, 315/220, 223, 244, DIG. 2, DIG. 4, DIG. 7, 287; 331/113 A; 362/133, 139

[56] References Cited

U.S. PATENT DOCUMENTS

| | | | |
|---|---|---|---|
| 2,997,664 | 8/1961 | Jensen | 331/62 |
| 3,155,875 | 11/1964 | Wenrich et al. | 331/113 A |
| 3,250,952 | 5/1966 | Barriball | 315/187 |
| 3,263,122 | 7/1966 | Genuit | 315/DIG. 7 |
| 3,305,697 | 2/1967 | Neusbaum | 315/247 |
| 3,346,821 | 10/1967 | Swyryd | 331/113 A |
| 3,753,071 | 8/1973 | Engel et al. | 363/139 |
| 3,778,677 | 12/1973 | Kriege | 331/113 A |
| 3,889,153 | 6/1975 | Pierce | 331/62 |
| 3,968,396 | 7/1976 | Clune | 315/74 |
| 4,008,414 | 2/1977 | Agnew | 315/97 |
| 4,060,752 | 11/1977 | Walker | 315/DIG. 7 |
| 4,075,476 | 2/1978 | Pitel | 315/205 |
| 4,117,373 | 9/1978 | Alley | 315/DIG. 7 |
| 4,158,792 | 6/1979 | Kuroi et al. | 315/DIG. 7 |
| 4,170,747 | 10/1979 | Holmes | 315/205 |
| 4,184,128 | 1/1980 | Nilssen | 315/220 X |
| 4,251,752 | 2/1981 | Stolz | 315/206 |
| 4,259,614 | 3/1981 | Kohler | 363/133 X |
| 4,277,728 | 7/1981 | Stevens | 315/247 |
| 4,350,929 | 9/1982 | Katoogi | 315/105 |
| 4,370,600 | 1/1983 | Zansky | 315/209 R X |
| 4,388,563 | 6/1983 | Hyltin | 315/209 R X |

*Primary Examiner*—Tan Dinh

[57] ABSTRACT

An electronic ballasting circuit provides high efficiency ballasting for most common types of fluorescent lamps. The circuit consists of a half-bridge inverter providing a substantially squarewave voltage across a series-combination of an inductor and a capacitor. The fluorescent lamp is connected in parallel circuit with the capacitor in such a way that the current flowing through the capacitor also flows through the lamp cathodes, thereby providing continuous low voltage heating therefor. The values of inductance and capacitance are so chosen that the series-combination has a natural resonance frequency that is substantially equal to or lower than the lowest frequency component present in the squarewave voltage. Because the lamp cathodes are connected in series with the L-C quasi-resonant circuit, the high voltage that may be generated across the capacitor due to its cooperative interaction with the inductor, is not present when the lamp is disconnected from the circuit; thereby rendering the lamp sockets free from electric shock hazard whenever the lamp is removed therefrom. The fluorescent lamps may be operated properly in either the instant-start or the rapid-start modes.

12 Claims, 1 Drawing Sheet

ELECTRONIC BALLAST FOR FLUORESCENT LAMPS

This is a Continuation of Ser. No. 07/158,104 filed Feb. 16, 1988, now abandoned; which is a Continuation of Ser. No. 06/541,489 filed Oct. 13, 1983, now abandoned; which is a Continuation of Ser. No. 06/342,107 filed Jan. 25, 1982, now abandoned.

BACKGROUND OF THE INVENTION

1. Field of the Invention

The present invention relates to fluorescent lamp ballasts, particularly of the kind commonly referred to as electronic or inverter ballasts.

2. Description of the Prior Art

There already exists a variety of electronic ballast circuits for fluorescent lamps. Some of these circuits are described in U.S. Pat. Nos. such as 3,579,026 issued to Paget, 4,042,852 issued to Zaderej & al, 3,371,244 issued to Boland, and 3,619,713 issued to Biega & al. Other circuits are represented by electronic ballasts available for purchase, such as from the Electronics Division of Thomas Industries Inc., Garland, Tex., or from the EE-Tech Division of Beatrice Foods Co., El Segundo, Calif., or from Toshiba Electric Equipment Corp. of Japan.

However, the presently available circuits are relatively complex and costly, and do not provide for adequately reliable products. Consequently, despite the many potential advantages of electronic ballasting as compared with regular magnetic ballasting—advantages such as substantially improved efficiency, much reduced size and weight, elimination of hum and flicker, increased lamp life, more effective lamp starting, etc.—electronic ballasting has not become very widespread in actual use.

The invention herein disclosed represents a different and much simplified approach to designing high-reliability electronic ballasts for fluorescent lamps.

BRIEF SUMMARY OF THE INVENTION

Objects of the Invention

A first object of the present invention is that of providing an electronic ballast circuit for fluorescent lamps that is particularly simple in construction.

A second object is that of providing a ballast circuit that innately provides for improved reliability as compared with other available circuits.

A third object is that of providing an electronic ballasting means that exhibits a particularly low level of electromagnetic radiated interference.

A fourth object is that of providing a ballast that is capable of providing the very high voltages required for instant-starting fluorescent lamps, yet—whenever the lamp is removed from its socket—automatically provides for reduction of the lamp socket voltages to safe and shock-free levels.

These and yet additional objects, features and advantages of the present invention will become apparent from the following description and appended claims.

BRIEF DESCRIPTION

In the present invention, a half-bridge transistor inverter is powered from a regular power line by way of an ordinary rectifier bridge and a center-tapped pair of filter capacitors.

It provides a substantially squarewave voltage of about 80 Volt RMS magnitude across a pair of inverter output terminals—without the use of any power transformer means.

A four-terminal fluorescent lamp is connected in series circuit with an inductor, and this series-combination is connected across the inverter output terminals. A capacitor is connected in parallel circuit with the fluorescent lamp in such a way that the current flowing through the capacitor also flows through the lamp cathodes.

Due to resonant or quasi-resonant cooperative interaction between the inductor and the capacitor, the voltage provided across the fluorescent lamp may be significantly higher than the 80 Volt RMS applied across the series-combination of the inductor and the capacitor-lamp parallel-combination. Thus, effective lamp starting is readily obtained—as is continuous low voltage cathode heating as well as properly limited current for continuous lamp operation—without the use of any power transformer, something that provides for significant overall circuit simplifications.

Due to L-C filtering action, the resulting lamp current has far fewer and weaker high frequency components as compared with the lamp current that results with conventional ballast circuits, where no lamp shunting capacitor is used. Thus, reduced lamp-radiated electromagnetic interference results.

Also, due to the phase-correction properties of the capacitor connected in parallel circuit with the fluorescent lamp, the power factor of the power drawn from the inverter output is much improved as compared to what it is in normal inverter ballast circuits. As a result of this improved power factor, the current drawn from the inverter is significantly lower than it otherwise would have been.

The inverter circuit is of the self-oscillating type and gets its positive feedback by way of a pair of current transformers driven by the current flowing through the inductor. When the lamp is disconnected from its drive circuit—even if the disconnection only involves a single one of the four lamp terminal pins—the current-flow through the inductor is broken; which results in cessation of inverter oscillation. Hence, with the lamp disconnected, the inverter does not oscillate and therefore does not provide any substantial output voltage.

The inverter circuit in configured as a half-bridge; which configuration—in comparison with the parallel push-pull circuit configurations normally used—has the advantage of substantially reducing the magnitude of the voltages that must be handled by the switching transistors in the inverter. In turn, this reduction of transistor voltages has the effect of greatly enhancing the reliability of the inverter means—making it far more capable of withstanding the voltage transients that unavoidably occur from time to time, such as voltage transients on the power line that may result from a nearby strike of lightning.

DETAILED DESCRIPTION

Figure 1:
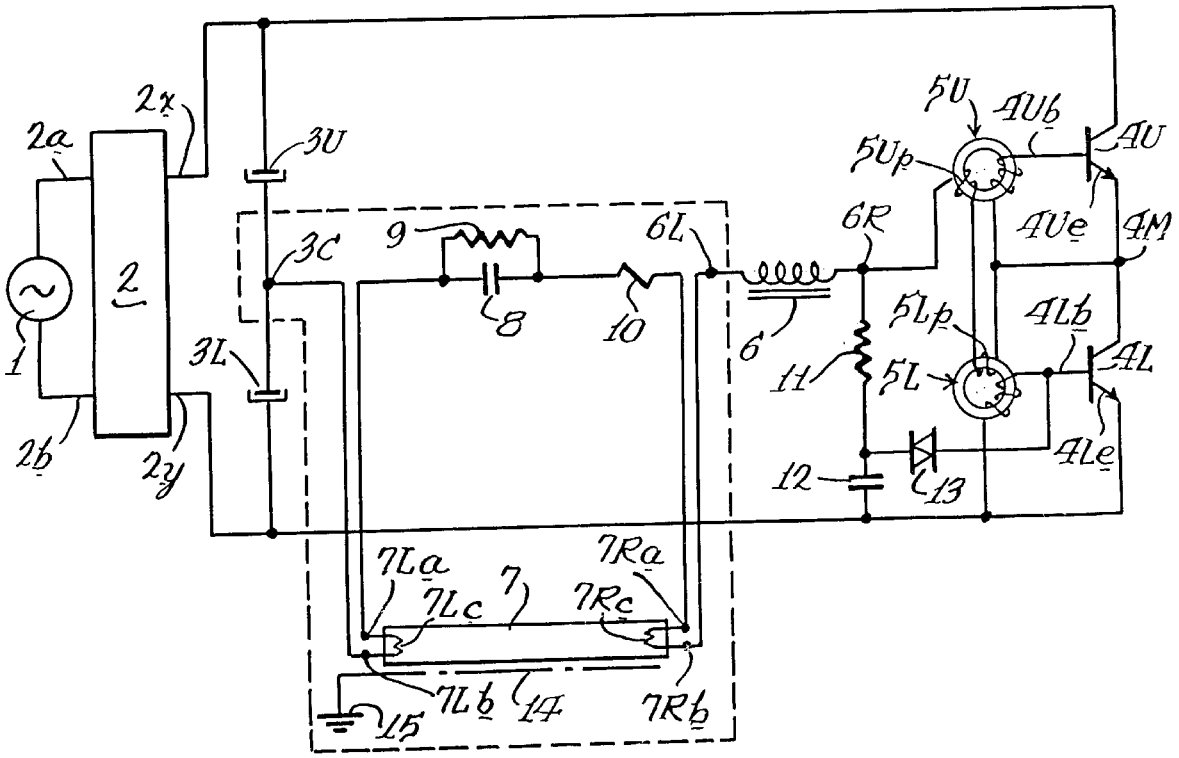
FIG. 1 represents a schematic diagram of a preferred embodiment of the complete ballasting circuit as adapted to operate a single rapid-start or pre-heat fluorescent lamp.

A preferred embodiment of the present invention is illustrated by FIG. 1. Shown there is a source of alternating voltage 1 connected to a rectifying means 2 by way of two input terminals 2*a* and 2*b*. The output from the rectifier means is provided as a unidirectional voltage across output terminals 2*x* and 2*y*, with 2*x* being the positive terminal and 2*y* being the negative terminal.

The unidirectional voltage output from the rectifier means is filtered by two series-connected capacitors 3U and 3L, which are joined together at center-tap 3C. The filtered unidirectional voltage output is applied across two series-connected transistors 4U and 4L; which two transistors are respectively controlled by saturable feedback transformers 5U and 5L. The secondary winding of transformer 5U is connected across base 4Ub and emitter 4Ue of transistor 4U; similarly, the secondary winding of transformer 5L is connected across base 4Lb and emitter 4Le of transistor 4L.

Mid-point 4M between the two transistors is connected to one terminal 6R of inductor 6 through the primary windings 5Up and 5Lp of transformers 5U and 5L. The other terminal 6L of inductor 6 is connected to center-tap 3C by way of the fluorescent lamp 7. This fluorescent lamp has four input terminals and two cathodes: terminals 7La and 7Lb are connected to cathode 7Lc; and terminals 7Ra and 7Rb are connected to cathode 7Rc.

Of these four lamp terminals, terminal 7Rb is directly connected with terminal 6L of inductor 6, terminal 7Lb is directly connected with center-tap 3C, and terminals 7Ra and 7La are connected together through a fusible link 10 and a parallel combination of a capacitor 8 and a resistor 9.

A resistor 11 is connected between one terminal of a capacitor 12 and terminal 6R of inductor 6. The other terminal of capacitor 12 is connected to output terminal 2*x* of rectifier means 2. One side of a Diac 13 is connected to the junction between resistor 11 and capacitor 12. The other side of this Diac is connected to base 4Lb of transistor 4L.

Adjacent to lamp 7 is placed a starting aid electrode 14 that is connected to ground 15.

In a typical application, suitable values or designations of the various parts of the circuit of FIG. 1 are listed as follows.

Output of voltage source 1: 120V & 60 Hz

Rectifier means 2: a bridge of four 1N4004 rectifiers

Capacitors 3U & 3L: 22uF & 100V

Transistors 4U and 4L: Motorola MJE13002

Toroids 5U and 5L: Ferroxcube 891(3E2A)

Primary windings 5Up and 5Lp: 2 turns of #22 wire

Secondary windings 5Us and 5Ls: 8 turns of #30 wire

Inductor 6: 130 turns of #26 wire on Ferroxcube Potcore 1408(3C8) with 10 mil gap Lamp 7: Westinghouse F13T5/CW Capacitor 8: 0.01uF & 600V Resistor 9: 470kOhm & ¼ Watt Fusible Link 10: 0.25 Amp Slow Blow Resistor 11: 10MegOhm & ¼ Watt Capacitor 12: 0. 01uF & 50 Volt Diac 13: General Electric ST-2

The frequency of inverter oscillation associated with the component values identified above is approximately 33 kHz.

The operation of the preferred embodiment of FIG. 1 may be explained as follows. Regular power line AC voltage, typically being 120 Volt @60 Hz, is applied to rectifier means 2 and converted to a unidirectional voltage. This unidirectional voltage is then filtered by the two series-connected capacitors 3U and 3L, across which is thus established a DC voltage of relatively constant magnitude. This DC voltage is then applied to the two series-connected transistors 4U and 4L.

In self-oscillating inverter fashion, these two transistors are alternately switched on and off by means of the two saturable positive feedback transformers 5U and 5L. This self-oscillating inverter arrangement operates in substantially the same manner as does the inverter arrangement described in FIG. 8 of U.S. Pat. No. 4,279,011 issued to Nilssen.

Thus, using center-tap 3C as a reference, a substantially squarewave voltage is generated at point 4M; which—because the voltage drop across the primary windings of transformers 5U and 5L is negligible in comparison with the amplitude of said squarewave voltage—means that substantially the same squarewave voltage is present at point 6R. Furthermore, this means that said substantially squarewave voltage—which is defined as the inverter output voltage—is present across the series connection of inductor 6 and the lamp assembly; which lamp assembly consists of lamp 7 with its four terminals connected in circuit with capacitor 8, resistor 9 and fusible link 10.

An important aspect of the present invention relates to the means for rendering the inverter inoperative whenever the lamp 7 is disconnected from at least one of its four terminals (7Ra, 7Rb, 7La, and 7Lb) or, equivalently, whenever one of its cathodes develops an open circuit. This aspect results from two factors. First, with the lamp disconnected, there is no path by which to provide the small amount of current required to operate the circuit trigger means (consisting of resistor 11, capacitor 12 and Diac 13), which trigger means must be operative in order to establish circuit oscillations. Second, again with the lamp disconnected, there is no electrical connection across the inverter output, which implies that—even if the trigger means were operative to trigger the circuit into oscillation—there is no way to make this oscillation sustain itself since there is no feedback current provided to the primary windings 5Up and 5Lp of the feedback transformers 5U and 5L. (The current drawn through resistor 11 is negligible in respect to providing an operative feedback current and thereby to sustain oscillations.)

Another important aspect of the present invention relates to means for effectively operating the fluorescent lamp 7 from the substantially squarewave inverter output voltage. This aspect is provided for as follows.

Before lamp 7 is ignited, the squarewave voltage present between center-tap 3C and point 6R is in effect presented to the series connection of inductor 6, capacitor 8 and the relatively low resistance present in the two cathodes 7Rc and 7Lc. (The impedance of resistor 9 is so high as to be negligible except in the sense of facilitating initiation of circuit oscillation.)

Thus, before lamp ignition, the voltage developed across capacitor 8, and the resulting current through the cathodes, essentially depend on two factors: 1) the natural resonance frequency of the series combination of capacitor 8 and inductor 6 as taken in combination with the frequency and the magnitude of the inverter output voltage; and 2) the effective circuit loading provided by the resistance of the two cathodes.

For efficient and reliable inverter operation, it is desirable to arrange the relationship between inductor 6 and capacitor 8 such that their natural series resonance frequency is somewhat lower than the fundamental frequency of the inverter output voltage.

The value of inductor 6 should be chosen mainly on the basis of providing the desired lamp operating current; which means that the value of capacitor 8 should be chosen in such a way as to provide for an appropriate lamp starting voltage. However, there is significant interaction between the value of inductor 6, capacitor 8 and the resulting lamp operating current, which provides for a good degree of design flexibility.

With the values of inductor 6 and capacitor 8 principally chosen on the basis of providing appropriate lamp starting voltage and operating current, the resulting current through the lamp cathodes may not necessarily be appropriate for optimum lamp performance. In fact, experiments with various configurations of the present invention have shown that with some of the presently available pre-heat types of fluorescent lamps the resulting cathode current is higher than desirable.

However, while it is indeed possible to provide fluorescent lamps with cathodes designed to operate optimally with the particular cathode current resulting with the circuit arrangement of FIG. 1, it is never-the-less desirable to have the circuit operate appropriately with any type of presently available fluorescent lamps. To accomodate the situations where the resulting cathode current is unacceptably high, it is readily possible to provide for a current shunting means across each of the lamp cathodes—as illustrated in FIG. 2.

Figure 2:
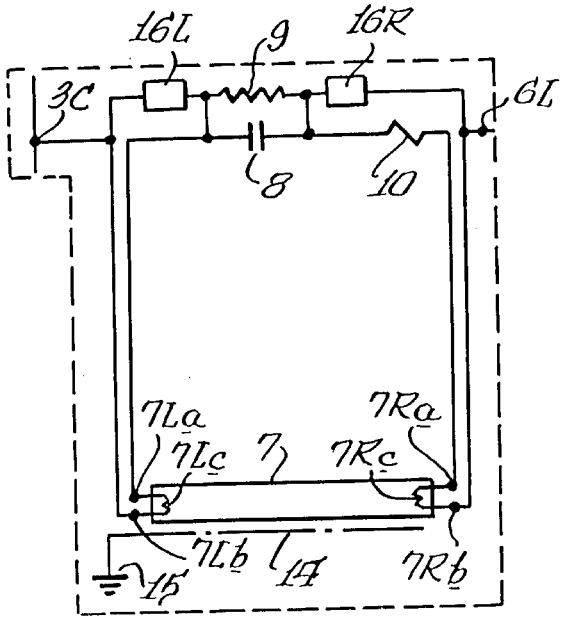
FIG. 2 illustrates a modification of a part of FIG. 1, illustrating thereby a ballasting circuit that can accomodate fluorescent lamps that require a lower amount of cathode current than that naturally provided by the circuit of FIG. 1.

FIG. 2 illustrates a modification of part of FIG. 1, the part connected between center-tap 3C and point 6L. The symbols used for identifying the various circuit components are the same for the two figures, except for the added cathode shunting means 16L (which is connected across cathode terminals 7La and 7Lb) and 16R (which is connected across cathode terminals 7Ra and 7Rb).

With a current shunting means present across each of the lamp cathodes, the resulting cathode current can be made to be as small as required. However, with such shunting means present, there may exist a path for inverter load current to flow even when the lamp is disconnected from the circuit. In other words, the removal of the lamp does not necessarily completely unload the inverter; which means that oscillations may continue after the lamp is disconnected. Such oscillations are undesirable and may even be destructive.

To prevent such undesirable and potentially destructive oscillations, the current shunting means may be chosen to be an impedance means of an electrically non-linear nature. For instance, by making each of the current shunting means a diode, a reduction of about 30% in cathode current is achieved in comparison with not having any shunting means. Yet, when now the lamp is disconnected at even just one of its terminals, the inverter will cease to oscillate. Moreover, as long as the polarity of at least one of the diodes is such as to prevent current from flowing from center-tap 3C to point 6L when the lamp is removed, inverter triggering will not occur when the lamp is removed.

With reference to both FIG. 1 and FIG. 2, once the lamp is started, its effective impedance falls to a much lower level than that which existed before starting; and the voltage across the lamp is now determined principally by the characteristics of the particular lamp used. On the other hand, current through the lamp is principally determined by the characteristics of the circuit; which provides for the significant functional advantage that lamp current will tend to remain the same without regard to type or length of lamp.

When the lamp is in operation, the voltage across it is nearly sinusoidal in waveshape and may be either larger or smaller in RMS magnitude than the inverter output voltage. The current through capacitor 8, and thereby through the cathodes and their shunting means, is also nearly sinuoidal and is now determined by the value of this capacitor in combination with the lamp voltage and frequency.

The fact that the voltage across the lamp is much lower after the lamp has started than it is just prior to starting, has the consequence of providing a much higher cathode current just prior to lamp starting than after the lamp has started. This consequence is generally a very desirable one in that it results in particularly rapid heating of the lamp cathodes; which means that lamp starting will be accomplished in a much shorter time than would otherwise be the case. Moreover, the process is a fail-safe one in that, as soon as the cathodes reach a temperature high enough to provide for adequate electron emission, the lamp will start; and the lamp voltage—and thereby the cathode current—will immediately fall to normal operating levels, thereby preventing the cathodes from reaching excessive temperatures.

However, in some cases it may be desirable to prevent the initial extra high cathode current. This can be accomplished by making the said cathode current shunting means provide the additional function of voltage limitation—such as may be achieved by using Zener diodes as cathode shunting means.

In the lamp circuit arrangements illustrated in FIG. 1 and FIG. 2, the magnitude of the lamp starting voltage is principally determined by the value chosen for capacitor 8. Care should be taken to prevent this lamp starting voltage from reaching excessively high levels. If excessive lamp starting voltages occur, lamp life will be detrimentally affected.

On the other hand, by intentionally providing for very high lamp starting voltages, the ballasting circuit of FIG. 1 may be used to start and operate instant-start fluorescent lamps. However, to prevent undesirable and potentially destructive inverter oscillation, it is still necessary to arrange for means by which the circuit is broken whenever the lamp is partly or fully disconnected from the ballasting circuit. According to the present invention, this can be accomplished in a number of ways, as for instance by using instant-start lamps with a pair of base-pins at each lamp end, and by providing for a short circuit across each of the pairs of said base pins. In FIG. 2, this would correspond to a direct electrical connection between cathode terminals 7La andf 7Lb, as well as between cathode terminals 7Ra and 7Rb.

Both in FIG. 1 and in FIG. 2 is shown a fusible link 10. Its purpose is that of breaking into an open circuit in the event that significantly higher-than-normal current were to flow through capacitor 8 for a considerable period (say, for more than a few seconds)—a condition which may occur with a faulty fluorescent lamp. By so opening the circuit, the oscillations will cease and circuit destruction is prevented. Of course, a thermally responsive and resetable circuit breaker may be used instead of the fusible link.

Also shown in FIG. 1 and FIG. 2 is a ground plane 15. This ground plane is positioned adjacent to lamp 7 and serves the purpose of providing lamp starting aid, particularly for situations where rapid-start lamps are used.

It is believed that the present invention and many of its attendant advantages will be understood from the preceeding description and that many changes may be made in the form and construction of its component parts, the form herein presented merely representing a preferred embodiment of the invention.

I claim:

1. A system for powering a gas discharge lamp having a a first and a second pair of cathode terminals, comprising:

a source having a pair of source terminals between which there is available an inductively limited AC current;

load circuit comprising a pair of load terminals with a capacitor means connected in circuit therebetween, one of said load terminals and one of said source terminals constituting a first pair of ballast terminals, the other load and source terminals constituting a second pair of ballast terminals;

non-linear voltage-limiting impedance means connected across at least one of said pairs of ballast terminals; and means for connecting said first and second pairs of cathode terminals respectively with said first and second pairs of ballast terminals.

2. An arrangement comprising:

a ballast circuit connected with a source of DC power and operative to supply an alternating current to a gas discharge lamp; the ballast circuit having a first pair and a second pair of ballast output terminals; a non-linear impedance means being connected between the pairs of ballast output terminals; and a gas discharge lamp having a first and a second pair of cathode terminals operable to connect with said first and second pair of ballast output terminals, respectively, thereby to be supplied with said alternating current.

3. An arrangement comprising:

a DC source operative to provide a DC voltage at a set of DC terminals;

a ballast circuit connected with the DC terminals; the ballast circuit having a pair of ballast terminals which, when connected with a proper load circuit, will supply a load current to this load circuit; the ballast circuit being characterized by drawing no current from the DC source except when the proper load circuit is connected with the ballast terminals; and a lamp circuit assembly operable to connect with the ballast terminals and, when indeed so connected, to constitute said proper load circuit; the lamp circuit being characterized by including a gas discharge lamp and a resistor connected in parallel therewith.

4. The arrangement of claim 3 wherein a capacitor is connected in parallel with the resistor.

5. The arrangement of claim 3 wherein a non-linear impedance means in connected in circuit with the gas discharge lamp.

6. An arrangement comprising:

a DC source operative to provide a DC voltage at a set of DC terminals;

a ballast circuit connected with the DC terminals; the ballast circuit having a pair of ballast terminals which, when connected with a proper load circuit, will supply a load current to this load circuit; the ballast circuit being further characterized by providing an output voltage across the ballast terminals only when connected with said proper load circuit; and a lamp circuit assembly operable to connect with the ballast terminals and, when indeed so connected, to constitute said proper load circuit; the lamp circuit being characterized by including a gas discharge lamp and a resistor.

7. An arrangement comprising:

a DC source operative to provide a DC voltage at a set of DC terminals;

a ballast circuit connected with the DC terminals; the ballast circuit having a pair of ballast terminals across which is at times provided an AC voltage; the ballast circuit being further characterized by providing the AC voltage only when a proper load circuit is connected with the ballast terminals; and a lamp circuit assembly operable to connect with the ballast terminals and, when indeed so connected, to constitute said proper load circuit; the lamp circuit being characterized by including a gas discharge lamp and a resistance means operative to provide for a resistive path between the ballast terminals as long as the lamp circuit assembly is indeed connected with the ballast terminals.

8. An arrangement comprising:

a DC source operative to provide a DC voltage at a set of DC terminals;

a ballast circuit connected with the DC terminals; the ballast circuit having a pair of ballast terminals across which is conditionally provided an AC voltage; the ballast circuit being further characterized by providing the AC voltage only having received a trigger signal; the trigger signal being automatically supplied, but only after a proper load circuit is connected with the ballast terminals; and a lamp circuit assembly operable to connect with the ballast terminals and, when indeed so connected, to constitute said proper load circuit; the lamp circuit being characterized by including a gas discharge lamp and a capacitor.

9. An arrangement comprising:

a DC source operative to provide a DC voltage at a set of DC terminals;

a ballast circuit connected with the DC terminals; the ballast circuit having a pair of ballast terminals which, when connected with a proper load circuit, will supply a load current to this load circuit; the ballast circuit being characterized by drawing no current from the DC source except when the proper load circuit is connected with the ballast terminals; the proper load circuit, when indeed so connected, being required to cause a resistive path to exist between the ballast terminals; and a lamp circuit assembly operable to connect with the ballast terminals and, when indeed so connected, to constitute said proper load circuit; the lamp circuit being further characterized by including a gas discharge lamp.

10. An arrangement comprising:

a DC source operative to provide a DC voltage at a set of DC terminals;

a ballast circuit connected with the DC terminals; the ballast circuit having a pair of ballast terminals which, when connected with a proper load circuit, will supply a load current to this load circuit; the ballast circuit being further characterized by providing an output voltage across the ballast terminals only when connected with said proper load circuit; and an assembly operable to connect with the ballast terminals and, when indeed so connected, to constitute said proper load circuit; the assembly being characterized by including a gas discharge lamp and a resistance means functional to cause a resistive path to exist between the ballast terminals whenever the assembly is indeed connected thereto.

11. An arrangement comprising:

a DC source operative to provide a DC voltage at a set of DC terminals;

a ballast circuit connected with the DC terminals; the ballast circuit having a pair of ballast terminals which, when connected with a proper load circuit, will supply an alternating current to this load circuit; the ballast circuit being further characterized by: (i) including a periodically conductive transistor; and (ii) providing an AC voltage across the ballast terminals, but only when connected with the proper load circuit; and a lamp assembly having a pair of assembly terminals operable to connect with the ballast terminals and, when indeed so connected, to constitute the proper load circuit; the lamp assembly being additionally characterized by: (i) being disconnectable; (ii) including a gas discharge lamp; and (iii) having a resistive path between the assembly terminals.

12. An arrangement comprising:

a DC source operative to provide a DC voltage at a set of DC terminals;

a ballast circuit connected with the DC terminals; the ballast circuit having a pair of ballast terminals which, when connected with a proper load circuit, will supply an alternating current to this load circuit; the ballast circuit being further characterized by providing an AC voltage across the ballast terminals, but only when connected with the proper load circuit; and a lamp circuit assembly having a pair of assembly terminals operable to connect with the ballast terminals and, when indeed so connected, to constitute the proper load circuit; the lamp circuit assembly being further characterized by including: (i) a gas discharge lamp; and (ii) a resistance means connected between the assembly terminals, the resistance means being characterized by being functional to conduct current even under conditions when the gas discharge lamp is non-ionized.

* * * * *